US007086565B2

(12) United States Patent
Beckwith

(10) Patent No.: US 7,086,565 B2
(45) Date of Patent: Aug. 8, 2006

(54) MODULE FOR DISPENSING ADHESIVE AND ADHESIVE APPLICATOR INCORPORATING THE MODULE

(76) Inventor: Robert E. Beckwith, 2272 Edendale Pl., Los Angeles, CA (US) 90039

( * ) Notice: Subject to any disclaimer, the term of this patent is extended or adjusted under 35 U.S.C. 154(b) by 55 days.

(21) Appl. No.: 10/746,504

(22) Filed: Dec. 29, 2003

(65) Prior Publication Data

US 2004/0134937 A1 Jul. 15, 2004

Related U.S. Application Data

(63) Continuation-in-part of application No. PCT/US02/020360, filed on Jun. 28, 2002.

(60) Provisional application No. 60/301,417, filed on Jun. 29, 2001.

(51) Int. Cl.
*B67D 3/00* (2006.01)

(52) U.S. Cl. ..... 222/63; 222/326; 222/333; 222/482; 222/565

(58) Field of Classification Search ..... 222/63, 222/326, 327, 333, 386, 482, 565

See application file for complete search history.

(56) References Cited

U.S. PATENT DOCUMENTS

| | | | | |
|---|---|---|---|---|
| 4,277,194 | A * | 7/1981 | Smith | 401/173 |
| 4,335,834 | A | 6/1982 | Zepkin | |
| 4,649,245 | A | 3/1987 | Lessig et al. | |
| 4,669,636 | A * | 6/1987 | Miyata | 222/153.01 |
| 5,749,498 | A | 5/1998 | Lavoie et al. | |
| 5,762,239 | A | 6/1998 | Cossette | |
| 5,775,539 | A | 7/1998 | Bates et al. | |
| 5,802,248 | A | 9/1998 | Miiller et al. | |
| 5,906,297 | A | 5/1999 | Cole | |
| 6,089,407 | A * | 7/2000 | Gardos | 222/137 |
| 6,321,945 | B1 * | 11/2001 | Girouard et al. | 222/113 |
| 2005/0051571 | A1 * | 3/2005 | Carruth et al. | 222/1 |

* cited by examiner

*Primary Examiner*—Joseph A. Kaufman
(74) *Attorney, Agent, or Firm*—Browdy and Neimark, PLLC

(57) ABSTRACT

A reusable or disposable adhesive dispensing cartridge including a housing for containing a quantity of adhesive, an adhesive delivery element connected to the housing and having a plurality teeth spaced apart by recesses and a plate movably mounted in the housing to force adhesive from the housing and through flow passages that extend between the interior of the housing and the recesses. An adhesive applicator includes a cartridge holder for retaining the cartridge and a movable drive element coupled to the cartridge plate to move the plate in a direction to force adhesive out of the housing and through the flow passages.

21 Claims, 5 Drawing Sheets

MODULE FOR DISPENSING ADHESIVE AND ADHESIVE APPLICATOR INCORPORATING THE MODULE

The present application is a continuation-in-part of International Application PCT/US02/020360, filed Jun. 28, 2002, and claims the benefit of U.S. Provisional Application No. 60/301,417, filed Jun. 29, 2001, the disclosures of both of which documents are incorporated herein by reference.

BACKGROUND OF THE INVENTION

The present invention relates to the application of adhesive to a surface.

When applying adhesive to a surface, for example for installation of ceramic tile or floor coverings, it is common practice to place a quantity of the adhesive on the surface and to then spread the adhesive with a notched trowel in order to create adhesive beads that are spaced apart. This procedure is time-consuming and inefficient, and requires a substantial amount of clean-up work.

BRIEF SUMMARY OF THE INVENTION

The present invention provides a novel adhesive dispensing cartridge that is disposable or refillable, and an adhesive applicator composed of the cartridge, a cartridge holder having a receptacle for retaining the cartridge and a movable drive element carried by the holder and coupled to the cartridge to force adhesive out of the cartridge.

The adhesive dispensing cartridge according to the invention is composed of a housing enclosing a space for containing a quantity of adhesive, the housing having a front end and a rear end, an adhesive delivery element connected at the front end of the housing, the element being composed of a plurality of teeth spaced apart by recesses and being provided with a plurality of adhesive flow passages extending between the space enclosed by the housing and the recesses, and a plate disposed in the space at the rear end of the housing, the plate cooperating with the housing to contain the adhesive and being movable within the housing toward the front end to force adhesive from the space and through the flow passages.

DETAILED DESCRIPTION OF THE INVENTION

Figure 1:
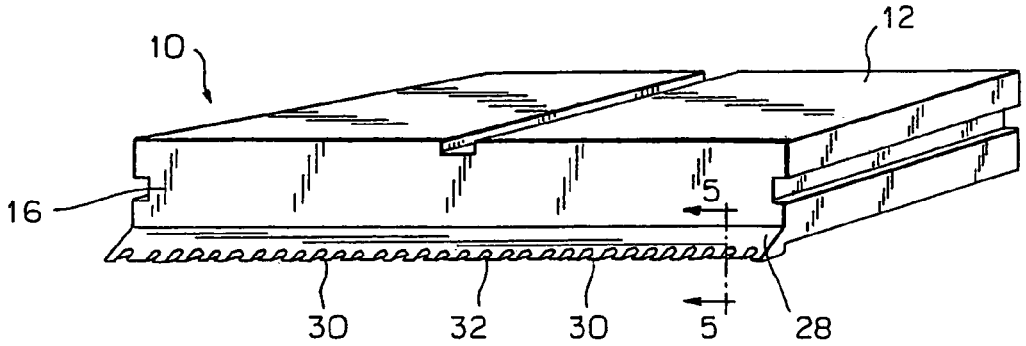
FIG. 1 is a perspective front view of one embodiment of a cartridge according to the invention.
Figure 2:
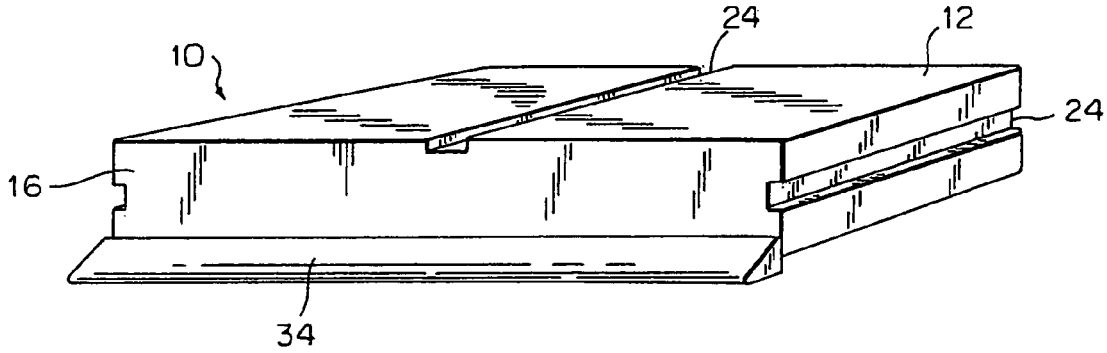
FIG. 2 is view similar to that of FIG. 1 showing the cartridge of FIG. 1 provided with a movable protective cap.
Figure 3:
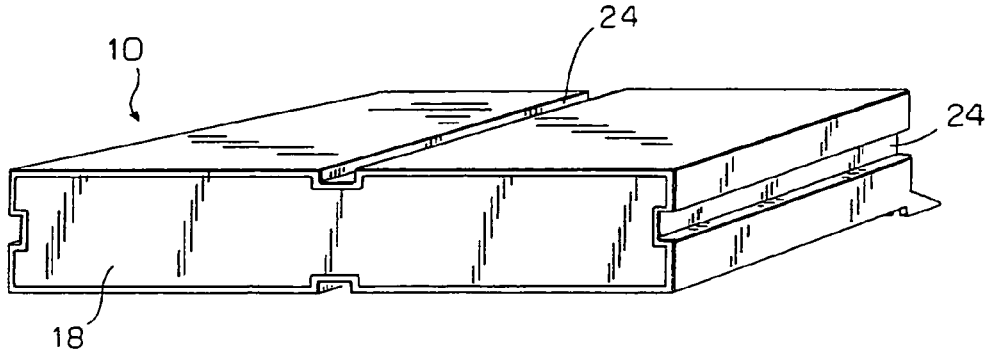
FIG. 3 is a perspective rear view of the cartridge of FIG. 1.

A preferred embodiment of a cartridge 10 according to the present invention is shown in FIGS. 1–3. This cartridge is composed essentially of a housing 12 having the general form of a rectangular prism and composed of a front end 16, a rear end 18, and upper side, a lower side, (not visible) and two lateral sides. At least two of the sides are each provided with at least one inwardly projecting land 24 that extends between ends 16 and 18.

Front end 16 is provided, along the lower edge thereof, with an adhesive dispensing element 28 formed to present a series of downwardly projecting teeth 30 spaced from one another by recesses 32.

Housing 12 has a hollow interior that is filled with an adhesive to be dispensed and rear end 18 is constituted by a plate that is movable relative to the remainder of housing 12 toward front end 16 so as to force adhesive out of dispensing element 28, as will be described in greater detail below. Thus, plate 18 will function as a primary plunger.

FIG. 2, which is a view similar to that of FIG. 1, shows element 28, covered with a protective cap 34 when cartridge 10 is not in use.

As can be seen in FIG. 3, plate 18 is provided at its edge with grooves that mate with lands 24.

Figure 4:
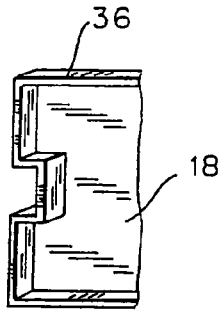
FIG. 4 is a detailed view of one end of a component of the cartridge of FIGS. 1–3.

FIG. 4 is a detail view of one end of plate 18, as viewed from within housing 12. According to one optional feature of the invention, plate 18 is provided with a flange 36 that extends around the entire periphery of plate 18 and projects into housing 12. Flange 36 and the grooves that mate with lands 24 cooperate to guide plate 18 so that it remains parallel to font end 16 while being displaced. In addition, flange 36 can be formed to serve as a seal and to prevent plate 18 from backing out of housing 12.

Figure 5:
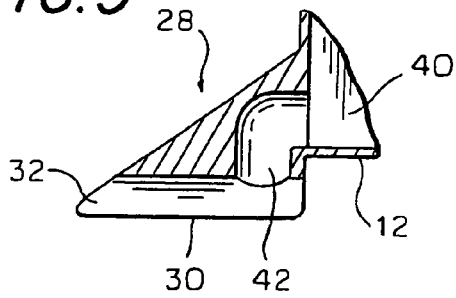
FIG. 5 is a cross-sectional view taken along line V—V of FIG. 1.

FIG. 5 is a cross-sectional view taken along line V—V of FIG. 1. FIG. 5 shows that housing 12 encloses a space, or chamber, 40 containing adhesive to be dispensed. Element 28 is provided with a plurality of adhesive flow passages 42 each extending between chamber 40 and the base of a respective one of recesses 32.

Figure 6:
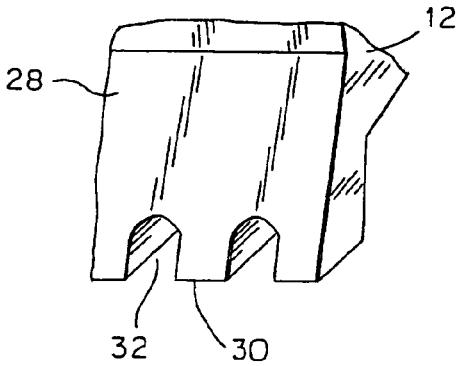
FIG. 6 is a detailed view of a front portion of an element of the cartridge of FIGS. 1–5.
Figure 7:
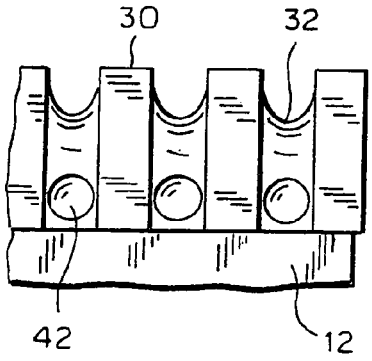
FIG. 7 is a bottom plan detail view of the portion shown in FIG. 6.

Further details of dispensing element 28 are shown in FIGS. 6 and 7. FIG. 6, in particular, shows that, in a preferred embodiment of the invention, each tooth has a flat bottom surface, while each recess 32 has a rounded bottom. FIG. 7 shows the location of the outlet end of each passage 42 at the base of its respective recess 32.

Figure 8:
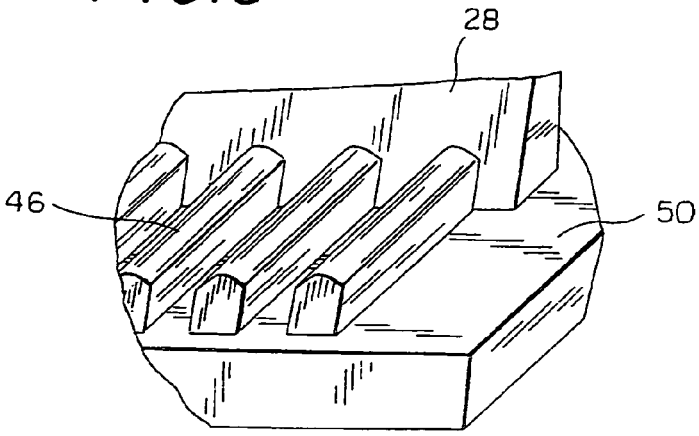
FIG. 8 is a perspective view depicting adhesive beads being produced by an applicator according to the invention.

FIG. 8 depicts adhesive beads 46 produced by an applicator according to the invention. In order to produce these beads, it is only necessary to move cartridge 10 rearwardly, i.e., in the direction from front end 16 to rear end 18, while simultaneously displacing plate 18 toward front end 16. As long as the lower surfaces of teeth 30 remain in contact with, or close to, the surface 50 to which the adhesive is to be applied, beads 46 will have cross sections corresponding to those of recesses 32.

Cartridge 10 may be made of any suitable material, such as aluminium, and may be either reusable or disposable.

Figures 9, 10, 11, 12, 13:
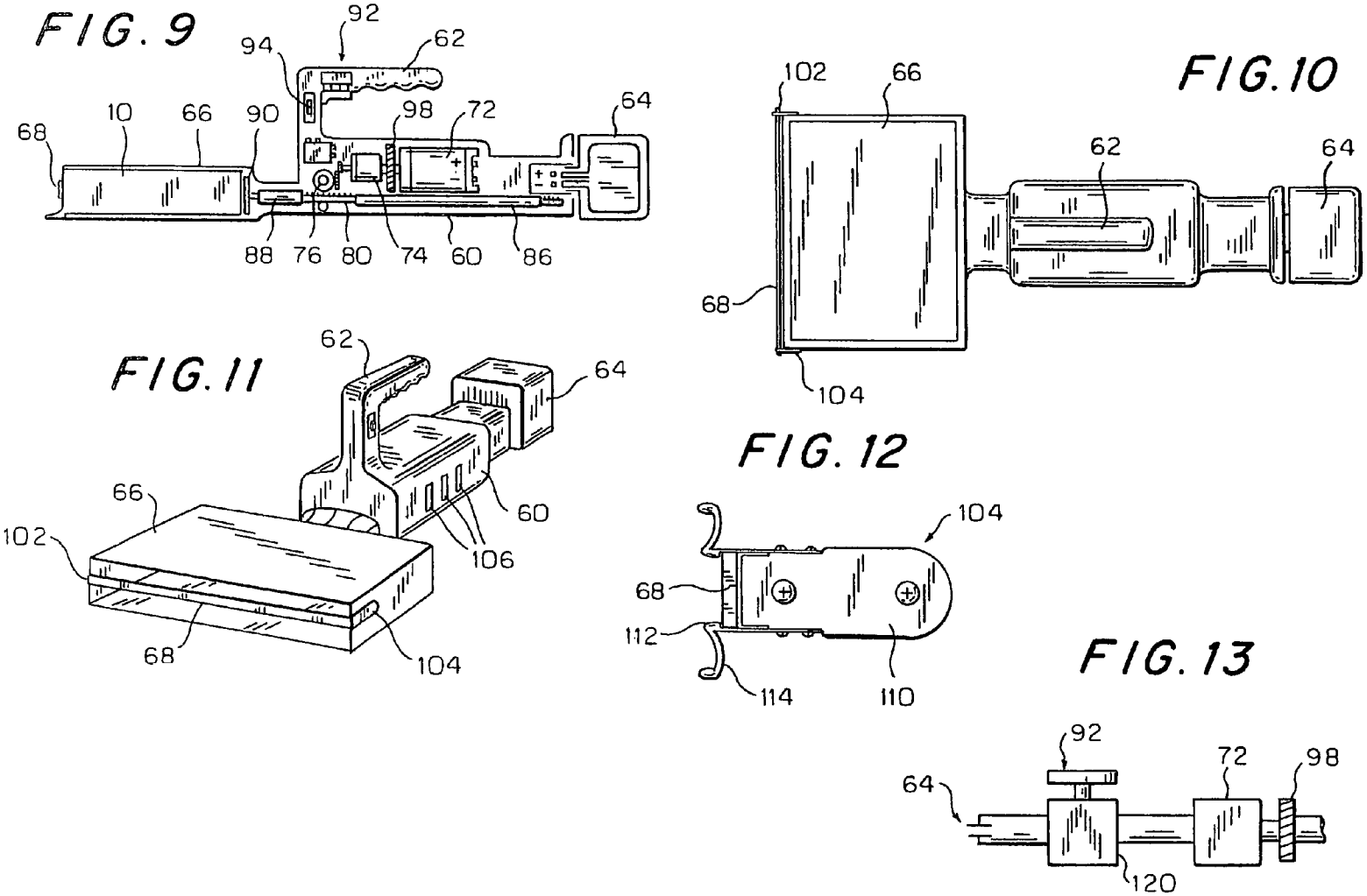
FIG. 9 is a simplified side elevational, cross-sectional view of a first embodiment of an applicator equipped with a cartridge according to the present invention.
FIG. 10 is a top plan view of the applicator shown in FIG. 9.
FIG. 11 is a front perspective view of the applicator.
FIG. 12 is an elevational view of one component of the applicator.
FIG. 13 is a simplified schematic diagram of a circuit for controlling operation of the applicator.

FIG. 9 is a simplified side elevational, cross-sectional view of an applicator equipped with a cartridge 10 according to the present invention. The applicator is a hand-held device having a main housing 60 from which extends a handle 62. The rear end of main housing 60 is provided with a receptacle for a battery 64, which is preferably rechargeable.

The front end of main housing 60 constitutes a cartridge receptacle 66 in which a cartridge 10 will be held when adhesive is to be dispensed. Cartridge 10 and receptacle 66 are dimensioned so that when cartridge 10 is held in place in receptacle 66, these lower surfaces of teeth 30 will be substantially flush with the lower surface of receptacle 66. Cartridge 10 will be held in place in receptacle 66 by a fastening bar 68 that extends across, and is in contact with, front end 16.

Housing 60 contains and electric drive motor 72 having an upward shaft connected to a transmission 74. Transmission 74 is, in turn, coupled to a bevel gear arrangement that includes an output 76. Gear 76 is coupled to cogged, or toothed, drive rod 80. Gear 76 and rod 80 thus form a rack and pinion mechanism. Rod 80 is preferably a solid rod having a square cross section and is guided for longitudinal movement in two guides 86 and 88 that are fixed in housing 60.

The output end of rod 80 carries a secondary plunger 90 that preferably corresponds closely in shape, but is slightly smaller then plate 18. Rotation of motor 72 thus produces linear movement of rod 80 to advance plunger 90 and plate 18 into cartridge 10, thus forcing adhesive through passages 42 and into recesses 32.

The operation of motor 72 is controlled by a manually operable variable speed trigger switch 92 and a forward/reverse switch 94 in handle 62. Trigger switch 92 is coupled to battery 64 and motor 72 in order to cause the speed of motor 72 to vary as a function of the degree of depression of trigger 92. Circuitry for performing such an operation is already well known in the art. The output shaft of motor 72 may also carry a fan 98 that will produce a flow of air for cooling motor 72.

FIG. 10 is a top plan view of the applicator shown in FIG. 9 and shows bar 68 pivotally mounted to a hinge 102. The free end of bar 68 engages a latch 104 that holds bar 68 in a closed position when the applicator is in use.

FIG. 11 is a front perspective view of the applicator, with no cartridge being provided in receptacle 66. Housing 60 is provided with a series of vents 106 that provide ventilating airflow. There may be three such vents along each side of housing 60.

FIG. 12 shows one example of latch 104, which is composed essentially of a mounting plate 110, tension spring clips 112 and clip release levers 114. When levers 112 are in their normal position, as shown in FIG. 12, bar 68 is held in a closed condition. In order to release bar 68, for example in order to replace a cartridge 10, the user deflects levers 114 toward the rear, thus moving levers 112 away from one another.

FIG. 13 is a simplified schematic diagram illustrating the connection of battery 64 to motor 72 via trigger 92. Trigger 92 is coupled to conventional control circuitry 120 that will vary the power supplied to motor 72 as a function of the degree of depression of trigger 92. By way of non-limiting example, circuitry 120 could include a simple potentiometer that varies the magnitude of the voltage supplied to battery 72, or could be a SCR control circuit that varies the rate of application of dry voltage pulses to motor 72. Circuit 120 could also be constructed according to the teachings of U.S. Pat. No. 4,649,245, Lessig, III et al, the disclosure of which is incorporated herein by reference. Those skilled in the art will be readily aware of other types of control circuits that can be employed. Control circuit 120 can be coupled in a suitable manner to switch 94 to allow for control of the direction of rotation of motor 72.

In order to dispense adhesive with the applicator according to the present invention, it is only necessary for the user to rest the bottoms of teeth 30 on the work surface and place motor 72 into operation while drawing the applicator rearwardly along the surface and controlling the speed of motor 72 in order to coordinate the rate at which adhesive is dispensed with the rate of displacement of the applicator. The application of beads to the work surface may be improved if the applicator is held at a slight angle to the work surface such that the leading edge, i.e., the edge furthest from front end 16, of the teeth are in contact with the surface and the bottom surfaces of the teeth form an angle of the order 5° with the work surface.

When the supply of adhesive in a cartridge has been exhausted, it is only necessary to replace the cartridge in order to continue adhesive application. The empty cartridge may be thrown away, since it is a relatively inexpensive component.

If, at the end of an adhesive application task, useable adhesive remains in the cartridge, cap 34 may be placed over element 28 in order to prevent accidental escape of adhesive and maintain the adhesive in a condition for future use. Cap 34 could be configured to additionally engage the rear edge of element 28 in order to completely seal the spaces defined by recesses 32.

Figure 14:
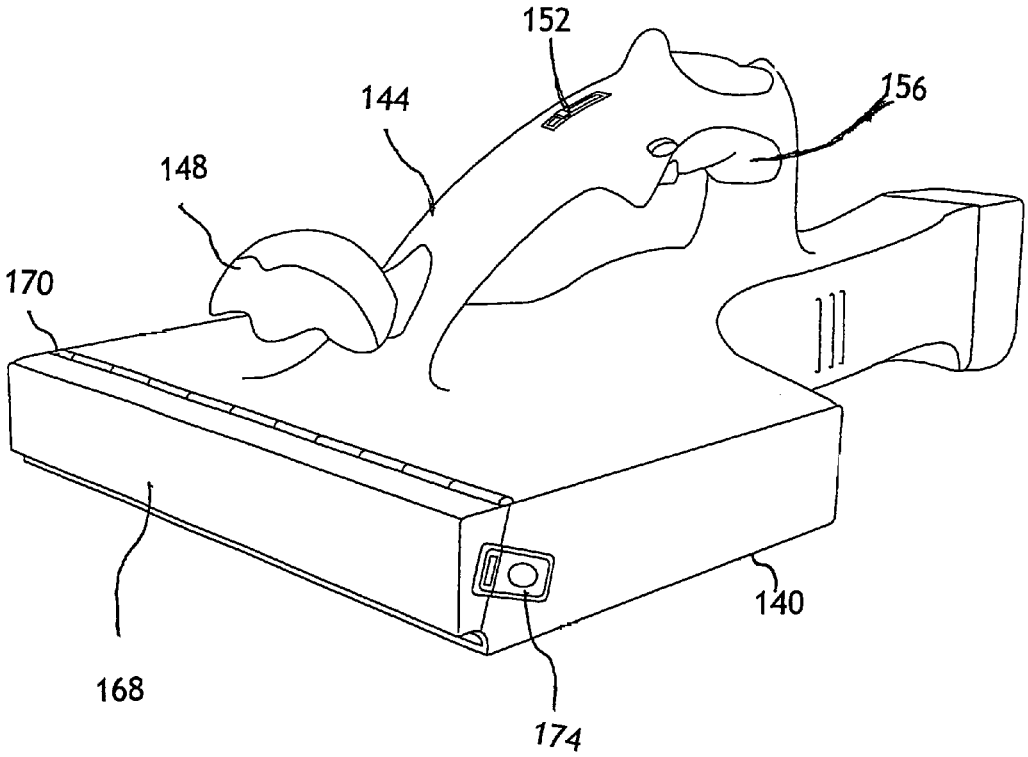
FIGS. 14 and 15 are, respectively, a perspective view and a side elevational view of a second embodiment of an applicator equipped with a cartridge according to the present invention.
Figure 15:
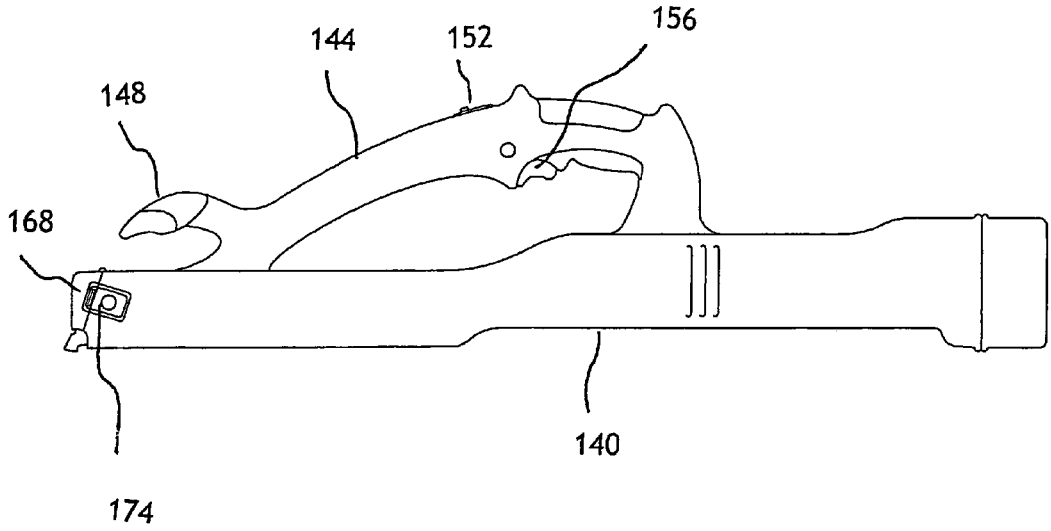

A second embodiment of the invention is shown in FIGS. 14 and 15. This embodiment has three novel features, any one or more of which could be incorporated into the embodiment of FIGS. 1–13. These features are: a curved handle fastened at both ends to the applicator housing; a multi-speed motor control; and a cartridge fastening gate that is connected to the front of the housing by a hinge having a horizontal axis.

FIGS. 14 and 15 show a housing 140 with an integrally-formed, curved handle 144 that is fastened at both ends to the upper surface of housing 140. Handle 144 is shaped to provide a generally D-shaped opening for receiving one hand of the user.

This curved handle construction provides two important advantages. Firstly, it helps to rigidify the entire housing. This is an important factor considering the length of the applicator and the inherent weight of a full cartridge, which can be as much as 13.5 lbs.

The second advantage is that it allows improved control of the applicator. Given the working weight of a loaded applicator, two-handed control is a necessity. The D-handle construction facilitates this efficiently by the provision a handgrip 148 at the front of the handle, and thus at the front of the applicator, for the other hand of the user. Preferably, handgrip 148 is placed as far forward and as low to the housing body as practically possible. The resulting forward hand position affords the user maximum control when using the applicator for either a vertical wall or horizontal floor application. Also preferably, the handle is positioned and dimensioned so that the center of gravity of the applicator, when loaded, is between the fore and aft grips.

The multi-speed motor control, as opposed to the continuously variable speed control of the first embodiment, provides a major advantage in that it allows the user to rely on any one of several recommended pre-set plunger speeds to govern the flow of adhesive from the cartridge. These speeds correlate directly with different cartridges filled adhesives having different flow characteristics applicable to the adhesion of specific materials. For example, adhesives for ceramic tile, vinyl and linoleum flooring, and laminate wood flooring may have different consistencies such that a different plunger speed is optimum for each adhesive. This feature is beneficial because and applicator according to the invention is intended to accept cartridges pre-filled with adhesives of different consistencies and having different sized application holes and teeth. The ability to select a plunger speed that is preset for a given type of adhesive considerably cuts down on the immediate skill, or learning curve, required when using this applicator.

In this embodiment, speed control 120 could be constructed in the manner described in U.S. Pat. No. 5,802,248, Miller et al, the disclosure of which is incorporated herein by reference.

The multi-speed motor control employs a speed setting switch 152 and an operating trigger 156, which may both be installed in handle 144, although they could be placed elsewhere on housing 140. Switch 152 may have two or more preset speed settings and, if desired, a variable speed setting allowing the plunger speed to be varied as a function of the amount of trigger depression, as in the first-described embodiment, The cartridge fastening gate of the second embodiment, shown at 168 in FIGS. 14 and 15, is mounted to housing 140 by a hinge 170 and is held in a closed position by pressure release latches 174 (one of which is not visible) at opposed ends of gate 168. Fastening gate 168 may have a generally rectangular form, with a long dimension and a short dimension, and is connected to housing 140 to pivot about an axis parallel to the long dimension, or about an axis that is horizontal when the applicator is in a position to apply adhesive to a floor surface. Pressure release latches 174 are disposed at the short sides of gate 168.

Fastening gate 168 provides important advantages. One of these is that it provides a complete and solid surface for the front of the cartridge to push against when the cartridge is under pressure during adhesive application. Upon release, the gate flips up and out of the way, staying close to the applicator, as opposed to the bar design of FIGS. 9–12 hinged on one side, which renders the hinge vulnerable to breakage at the hinge point when in the open position.

Latches 174 can be devices that are widely used, such conventional portable power applicator battery pack releases.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

The invention claimed is:

1. An adhesive dispensing cartridge comprising:

a housing enclosing a space for containing a quantity of adhesive, said housing having a front end and a rear end;

an adhesive delivery element connected at said front end of said housing, said element being composed of a plurality of teeth spaced apart by recesses and being provided with a plurality of adhesive flow passages extending between said space enclosed by said housing and said recesses; and a plate disposed in said space at said rear end of said housing, said plate cooperating with said housing to contain the adhesive and being movable within said housing toward said front end to force adhesive from said space and through said flow passages, wherein each of said recesses has an inlet end and an outlet end, the inlet and outlet ends being spaced apart in the direction between the front and rear ends of said housing, and each of said adhesive flow passages has an outlet that opens into a respective one of said recesses between said inlet and outlet ends.

2. The cartridge of claim 1, wherein each of said teeth and said recesses has a width in a direction transverse to the direction between said front and rear ends, and the widths of said teeth are substantially equal to the widths of said recesses.

3. The cartridge of claim 2 wherein said recesses have rounded bottoms.

4. The cartridge of claim 1 wherein said recesses have rounded bottoms.

5. The cartridge of claim 1 wherein said plate has a periphery provided with a flange that contacts said housing to cause said plate to maintain an orientation parallel to said front and rear ends of said housing.

6. The cartridge of claim 5 wherein said housing is provided with lands that protrude into said space and said plate is provided with grooves that mate with said lands to guide said plate in said space.

7. An adhesive applicator comprising:

the cartridge according to claim 1;

a cartridge holder having a receptacle for retaining said cartridge; and a movable drive element carried by said holder and coupled to said plate to move said plate toward said front end of said housing.

8. The applicator of claim 7 further comprising:

an electric motor connected to move said drive element; and a switch circuit for controlling said motor.

9. The applicator of claim 8 wherein said switch circuit is operative to cause said element to be moved at a variable speed.

10. The applicator of claim 8, wherein said switch circuit comprises a multi-speed control having a plurality of discrete speed settings, and a trigger for activating said motor to operate at a speed determined by the speed setting of said control.

11. The applicator of claim 7, further comprising a movable closing element mounted to said cartridge holder to retain said cartridge in said receptacle.

12. The applicator of claim 11, wherein said closing element is pivotably connected to said cartridge holder.

13. The applicator of claim 12, further comprising a latch member for holding said closing element in a position for closing said receptacle.

14. The applicator of claim 12, wherein said closing element has a long dimension and a short dimension and is connected to said cartridge holder to pivot about an axis parallel to the long dimension.

15. The applicator of claim 8, further comprising:

an applicator housing that includes said cartridge housing and that contains said drive element and said motor; and a handle having two opposed ends, each secured to said applicator housing.

16. The applicator of claim 15, wherein said applicator has a center of gravity when said cartridge is installed in said receptacle, and wherein the center of gravity is located between said opposed ends of said receptacle.

17. The applicator of claim 16, wherein said switch circuit comprises manually operable control elements mounted on said handle.

18. The applicator of claim 15, wherein one of said ends of said handle is located proximate to the location of said front end of said cartridge housing when said cartridge is installed in said receptacle.

19. The applicator of claim 18, wherein said one end of said handle is provided with a hand grip.

20. The applicator of claim 7, further comprising:

an applicator housing that includes said cartridge housing and that contains said drive element and said motor; and a handle having two opposed ends, each secured to said applicator housing.

21. An adhesive dispensing cartridge for dispensing adhesive in the form of beads as said cartridge is displaced in a given direction, each bead having a defined cross section, said cartridge comprising:

a housing enclosing, a space for containing a quantity of adhesive, said housing having a front end and a rear end, said front and rear ends being spaced apart in the given direction;

an adhesive delivery element connected at said front end of said housing, said element being composed of a plurality of teeth that extend in the given direction and are spaced apart in a direction transverse to the given direction by recesses and being provided with a plurality of adhesive flow passages each extending between said space enclosed by said housing and a respective one of said recesses, each of said recesses having a cross-section corresponding to the cross-section of each of the beads and acting to form the beads as said cartridge is displaced in the given direction; and a plate disposed in said space at said rear end of said housing, said plate cooperating with said housing to contain the adhesive and being movable within said housing toward said front end to force adhesive from said space and through said flow passages and from said flow passages into said recesses, wherein each of said recesses has an inlet end and an outlet end, the inlet and outlet ends being spaced apart in the direction between the front and rear ends of said housing, and each of said adhesive flow passages has an outlet that opens into a respective one of said recesses between said inlet and outlet ends.

* * * * *